US005095953A

United States Patent [19]

Makino

[11] Patent Number: 5,095,953

[45] Date of Patent: Mar. 17, 1992

[54] COMPUTER CONTROL OF AUXILIARY WEFT NOZZLES IN A MULTI-COLOR JET LOOM

[75] Inventor: Yoichi Makino, Kariya, Japan

[73] Assignee: Kabushiki Kaisha Toyoda Jidoshokki Seisakusho, Kariya, Japan

[21] Appl. No.: 549,288

[22] Filed: Jul. 6, 1990

[30] Foreign Application Priority Data

Jul. 14, 1989 [JP] Japan ..... 1-183357

[51] Int. Cl.[5] ..... D03D 47/30

[52] U.S. Cl. ..... 139/435.2; 139/435.5

[58] Field of Search ..... 139/435.1, 435.5, 435.2

[56] References Cited

U.S. PATENT DOCUMENTS 4,646,791 3/1987 Tsuji et al. ..... 139/435.2

4,901,770 2/1990 Takegawa .

*Primary Examiner*—Andrew M. Falik

*Attorney, Agent, or Firm*—Brooks Haidt Haffner & Delahunty

[57] ABSTRACT

A weft insertion control apparatus for a multi-color jet loom comprises a plurality of solenoid valves for controlling supply of a pressurized fluid to weft inserting auxiliary nozzles, an on/off controller for controlling these valves independently of one another, a first memory for storing a weft color selection pattern, and a second memory for storing on/off timing for the individual valves on a weft basis. The on/off controller reads out the weft color selection pattern stored in the first memory for every rotation of the loom and selects the preset on/off timing from the second memory on the basis of the result of the reading thereby controlling the valves.

5 Claims, 4 Drawing Sheets

COMPUTER CONTROL OF AUXILIARY WEFT NOZZLES IN A MULTI-COLOR JET LOOM

BACKGROUND OF THE INVENTION

1. Field of the Invention

The present invention relates to a weft insertion control method and apparatus for selecting one of a plurality of wefts in accordance with a weft color selection pattern for insertion into a multi-color fabric being woven by a multi-color jet loom.

2. Description of the Prior Art

In a multi-color loom, in which a single pressurized fluid supply system is provided for weft insertion auxiliary nozzles, the pressure of jets produced by the weft insertion auxiliary nozzles is generally so set as to conform to the lowest running speed of a weft among those of different types. This can be explained by the fact that in case the jet pressure of the auxiliary nozzles is set in accordance with a weft having a higher running speed, the period for the tip of the weft having a lower running speed to reach the end position will be delayed, causing a faulty weft insertion. However, even in cases where the jet pressure is set in accordance with the weft of the lowest running speed, the weft which can be fed at an intrinsically higher speed will then tend to run at a speed abnormally higher than the desired speed, resulting in yarn breakage and wasteful consumption of pressurized fluid.

Weft insertion controlling systems which tackle the above-mentioned problem are disclosed in JP-A-58-126344 (Japanese Patent Application Laid-Open No. 126344/1983) corresponding to U.S. Pat. No. 4,534,387, JP-A-59-125942 and JP-A-59-130348 corresponding to U.S. Pat. No. 4,646,791. More particularly, in the weft insertion control systems disclosed in JP-A-58-126344 and JP-A-59-125942, a plurality of pressurized fluid supply systems of different pressures are provided in parallel to each weft inserting auxiliary nozzle, wherein one of the plurality of pressurized fluid supply systems is selectively connected to the weft inserting auxiliary nozzles depending on the type of weft to be inserted.

In the weft insertion control apparatus disclosed in JP-A-59-130348, a group of weft inserting auxiliary nozzles is provided for each type of weft and adapted to be connectable to an associated one of a plurality of pressurized fluid supply systems of different pressures, wherein one of the plural weft inserting auxiliary nozzle groups is selected for use from the plural groups of the weft inserting auxiliary nozzles in accordance with the type of weft to be inserted.

However, the weft insertion control apparatus of JP-A-59-125942 suffers from problems in that the space for installation is increased and the piping arrangement is complicated because a pressurized fluid supply tank must be provided for each type of weft in order to constitute a plurality of pressurized fluid supply systems. On the other hand, the weft insertion control apparatus of JP-A-58-126344 is disadvantageous in that increases in the cost involved as well as complicated piping are inevitable because a plurality of pressure control valves are interposed in parallel between the pressurized fluid supply tanks and the weft inserting auxiliary nozzles in order to constitute a plurality of pressurized fluid supply systems.

In the weft insertion control apparatus of JP-A-59-130348, the problems mentioned above are more serious, because of the increase in the number of weft inserting auxiliary nozzles.

SUMMARY OF THE INVENTION

It is therefore an object of the present invention to provide a weft insertion control method and apparatus, which are capable of satisfactorily achieving multi-color weft insertion while avoiding problems such as the increase in the cost and the space for installation and complication in the piping, which the prior art systems have encountered.

In view of the above and other objects which will be more apparent as description proceeds, there is provided according to a general aspect of the present invention a weft insertion control apparatus for a multi-color jet loom which comprises a plurality of solenoid valves for controlling supply of a pressurized fluid to weft inserting auxiliary nozzles, an on/off control means for controlling on/off (i.e., opening/closing) of these solenoid valves independently of one another, first storage means for storing a weft color selection pattern, and second storage means for storing on/off timing for the individual solenoid valves on a weft basis, wherein the on/off control means reads out the weft color selection pattern stored in the first storage means for every rotation of the loom and selects the preset on/off timing from the second storage means on the basis of the result of the reading thereby controlling the solenoid valves. Since jet looms of the type described have a main crankshaft, as is well known in the art, rotation of this crankshaft is referred to herein as "rotation of the loom" or simply "rotation".

According to the teaching of the present invention, the on/off control means reads out the weft color section pattern preset and stored in the first storage means upon every complete rotation of the loom and selectively reads the on/off timing information from the second storage means depending on the type of weft to be next inserted on the basis of the result of the reading, to thereby perform the on/off control of the solenoid valves. The on/off timing may be so established that the opening or ON period of the solenoid valves for the weft inserting auxiliary nozzles is increased for the type of weft having an inherently low running speed, while the ON period or jet duration is decreased for the type of weft having an intrinsically high running speed.

According to another aspect of the present invention, there is provided a weft insertion control method which is capable of performing an improved weft insertion control by setting the on/off timing mentioned above for each of the types of the wefts to be inserted.

BRIEF DESCRIPTION OF THE DRAWINGS

For a better understanding of the invention, reference may be had to the accompanying drawings, in which.

DESCRIPTION OF THE PREFERRED EMBODIMENT

In the following, the present invention will be described in conjunction with a preferred embodiment thereof which is incarnated as the weft insertion control apparatus for a two-color jet loom, by way of example.

Figure 1:
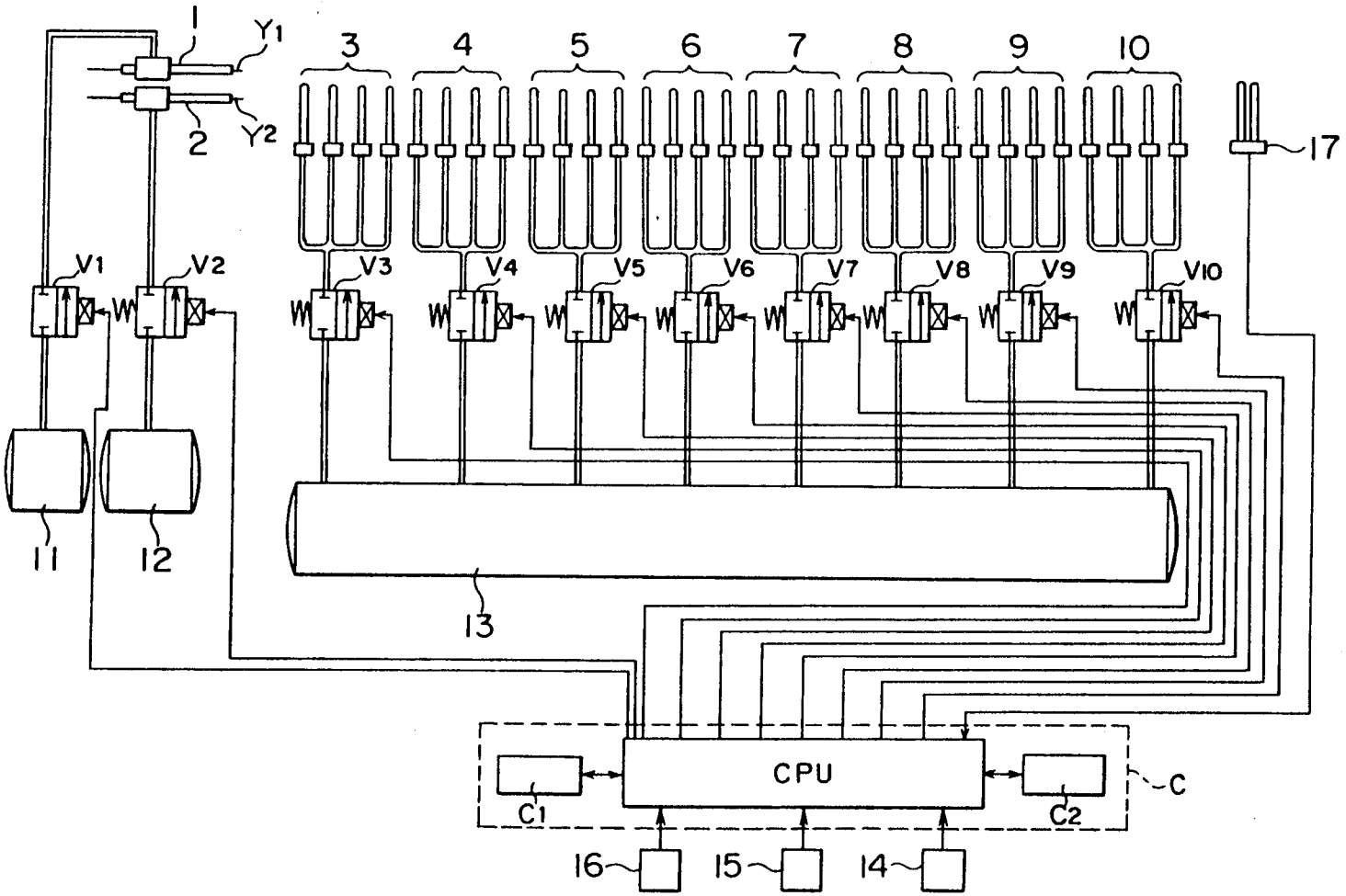
FIG. 1 is a front elevational view showing schematically the structure of a weft insertion control apparatus according to a preferred embodiment of the present invention.

Referring to FIG. 1, a weft $Y_1$ of a small count is ejected from a weft inserting main nozzle 1, being carried by a pressurized air jet therefrom, while a weft $Y_2$ of a large count is expelled from a weft inserting main nozzle 2 by a pressurized air jet, whereon the wefts $Y_1$ and $Y_2$ are transferred to relaying transportation effected by jets produced sequentially by a plurality of weft inserting auxiliary nozzles set in groups 3, 4, 5, 6, 7, 8, 9 and 10. When the weft inserting has been performed in a satisfactory manner, the inserted weft is detected by a weft detector 17 at a rotation angle of the loom within a predetermined range, whereby loom operation is allowed to continue. Reversely, when the presence of the weft is not detected within the predetermined range of loom rotation angle, the loom operation is then stopped.

The ejections of pressurized air jets from the corresponding weft inserting main nozzles 1 and 2 are controlled by turning on/off solenoid valves $V_1$ and $V_2$ provided in association with the main nozzles 1 and 2, respectively. On the other hand, the ejections of pressurized air jets from the associated weft inserting auxiliary nozzles of the groups 3 to 10 are controlled by turning on/off the solenoid valves $V_3$, $V_4$, $V_5$, $V_6$, $V_7$, $V_8$, $V_9$ and $V_{10}$ provided in association with these nozzle groups, respectively. The solenoid valves $V_1$ and $V_2$ are connected to pressurized air supply tanks 11 and 12 provided independent of each other, while the solenoid valves $V_3$ to $V_{10}$ are connected to a single pressurized air supply tank 13.

The on/off (opening/closing) control of the solenoid valves $V_1$, $V_2$ and $V_3$ to $V_{10}$ are performed under the commands of a loom control computer C which is so programmed as to issue the on/off commands to the individual solenoid valves $V_1$, $V_2$ and $V_3$ to $V_{10}$ in response to a loom rotation angle detection signal produced by a rotary encoder 14.

Selective insertion of the wefts $Y_1$ and $Y_2$ is conducted in accordance with a preset weft color pattern loaded previously in a memory $C_1$ from a weft color selecting pattern input unit 15 through a central processing unit CPU constituting a main part of the loom control computer C. More specifically, the central processing unit CPU reads out the weft color selecting pattern information from the memory $C_1$ at a predetermined angle $\theta$ of loom rotation which can be derived from the detection signal of the rotary encoder 14, whereby commands for turning on or off the solenoid valves $V_1$ or $V_2$ which correspond to the weft to be inserted next are generated on the basis of the information as read out.

The loom control computer further incorporates a memory $C_2$ in which on/off timing information for the solenoid valves $V_1$, $V_2$ and $V_3$ to $V_{10}$ (hereinafter $V_3$ to $V_{10}$ will be denoted collectively by $V_{2+i}$, where i represents 1 to 8) are previously loaded from an on/off timing setting unit 16 through the central processing unit CPU. Thus, the central processing unit CPU can command the on/off operation of the solenoid valves $V_1$, $V_2$ and $V_{2+i}$ in accordance with the on/off timing information stored in the memory $C_2$. For both the solenoid valves $V_1$ and $V_2$, the same on/off timing is set so that the pressurized air jets are ejected at the same time point from both the weft inserting main nozzles 1 and 2.

Figure 2A:
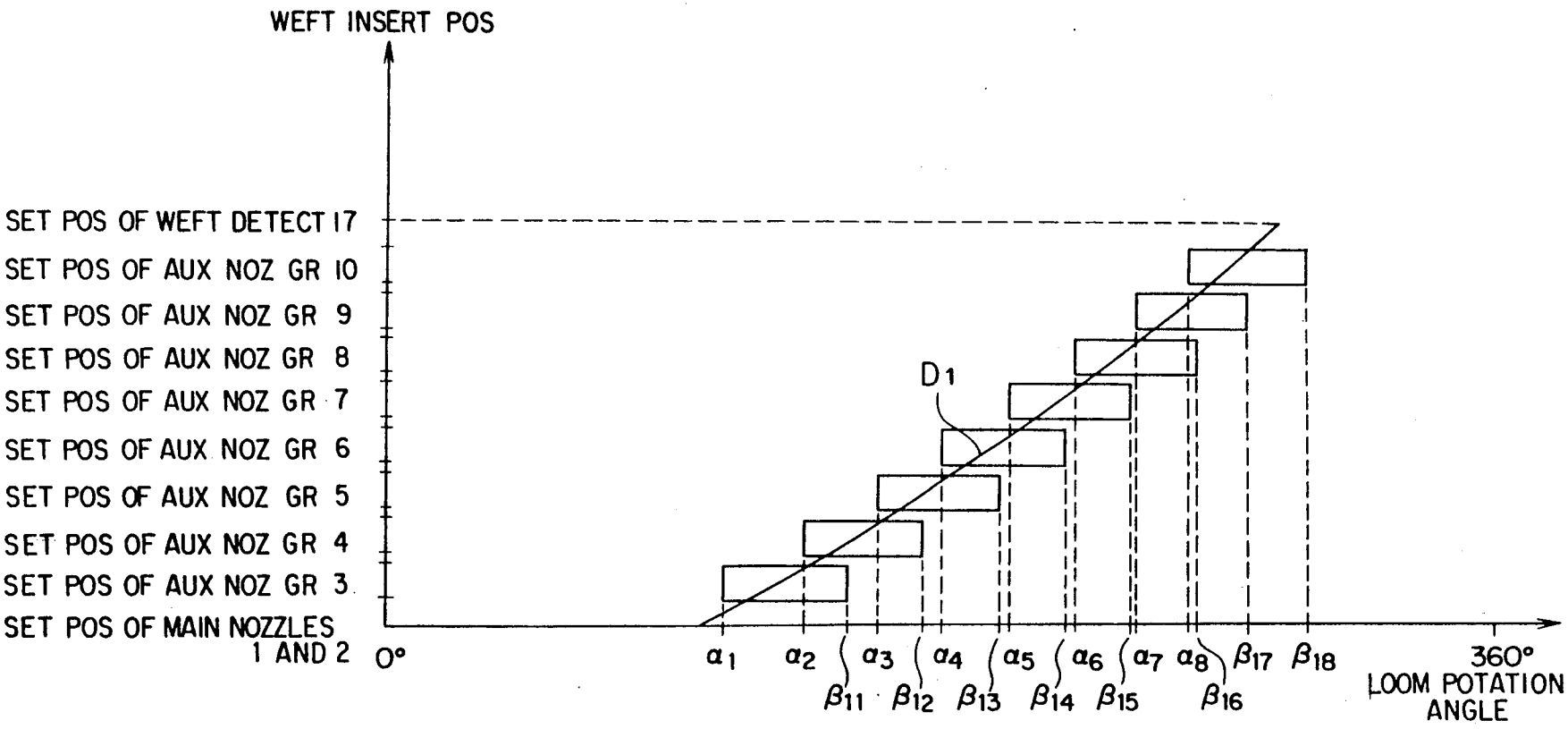
FIG. 2A and FIG. 2B are views for graphically illustrating jet timings in the weft insertion control apparatus shown in FIG. 1.
Figure 2B:
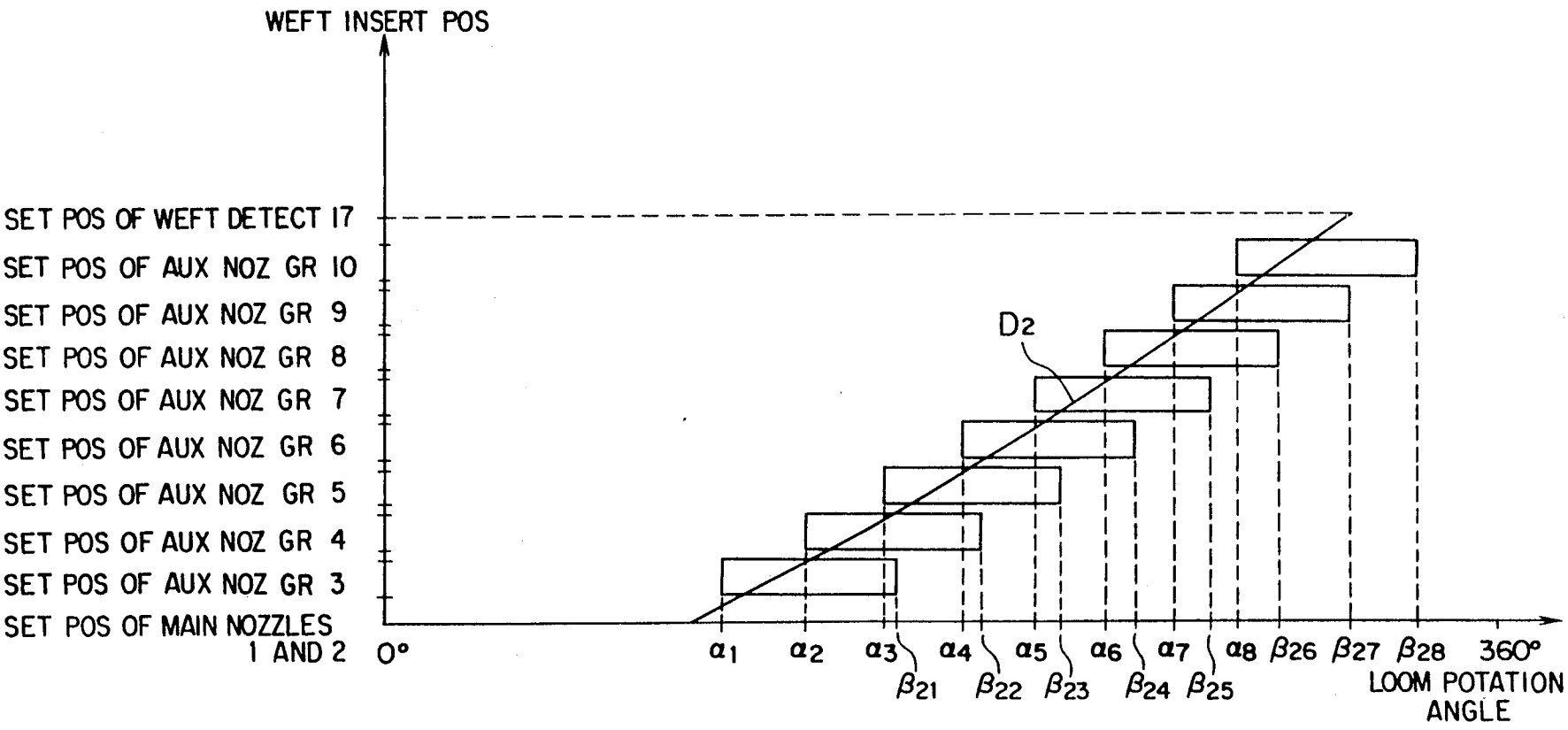

The jet timing for the weft inserting auxiliary nozzle groups 3 to 10 effectuated by on/off control of the solenoid valves $V_{2+i}$ is set as $[\alpha_1, \beta_{1i}]$ (i=1 to 8) expressed in terms of the loom rotation angle range for the weft $Y_1$ of a small count, as shown in FIG. 2A, while being set as $[\alpha_1, \beta_{2i}]$ (i=1 to 8) for the weft $Y_2$ of a large count, as shown in FIG. 2B.

Now, the weft insertion control will be explained by reference to FIG. 3 which shows in a flow chart a weft insertion control procedure, by way of example.

Referring to the figure, at the loom rotation angle of $\theta$, the central processing unit CPU reads out the weft color selecting pattern from the memory $C_1$ to thereby determine the type of the weft to be next inserted. When the weft $Y_1$ is the one to be next inserted, the central processing unit CPU reads out selectively from the memory $C_2$ the on/off timing $[\alpha_i-\Delta, \beta_{1i}-\Delta]$ (where $\Delta$ represents a delay in response in terms of angle) for the solenoid valves $V_{2+i}$ to thereby command the turn-on (opening) of the solenoid valves $V_{2+i}$ at the loom rotation angles corresponding to $(\alpha_i-\Delta)$, while commanding the turn-off (closing) of the solenoid valves $V_{2+i}$ at the loom rotation angles $(\beta_{1i}-\Delta)$, respectively. Thus, the weft inserting auxiliary nozzle groups connected to the solenoid valves $V_{2+i}$ are correspondingly actuated to produce air jet streams within the range of loom rotation angles of $\alpha_i$ to $\beta_{1i}$, as the result of which the weft $Y_1$ is caused to run as indicated by a curve $D_1$ shown in FIG. 2A.

Figure 3:
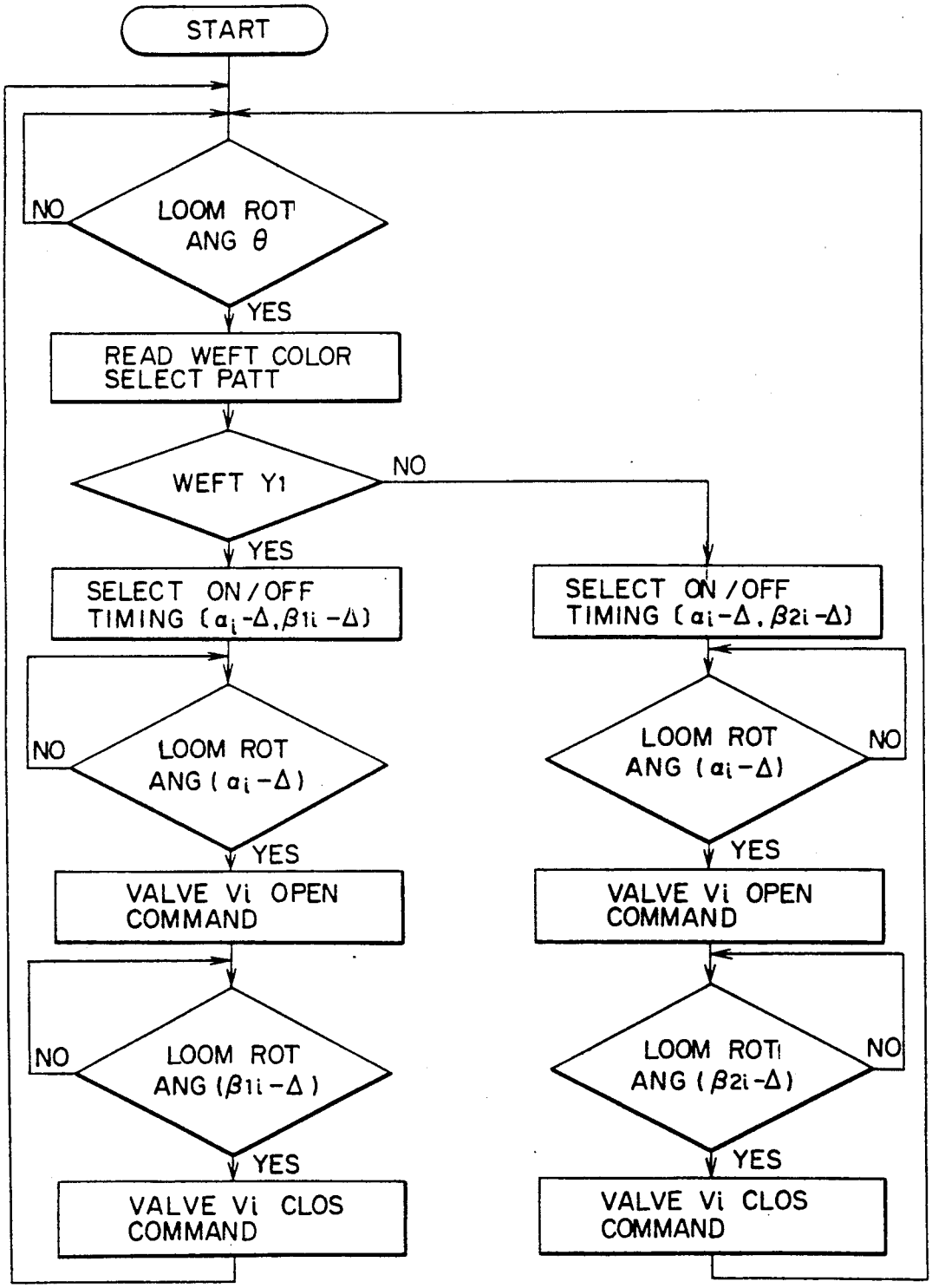
FIG. 3 is a flow chart showing a weft insertion control processing performed according to an embodiment of the invention.

FIG. 3 uses the conventional computer flow chart symbols, in which a diamond-shaped box represents a decision and arrows represent paths and sequences of instruction execution. Each diamond-shaped decision box represents an instruction. The upwardly-directed "NO" arrows in FIG. 3 show that the next process step of the sequence is not to be undertaken. Thus, upon detection of loom rotation, the rotary encoder 14 shown in FIG. 1 transmits a signal representing an angle of loom rotation to the CPU. The CPU monitors the detected signal and reads out the weft color selecting pattern stored in memory $C_1$, only if the angle of loom rotation reaches a predetermined value $\theta$. That is, the uppermost "NO" arrow of FIG. 3 means that the CPU continues to monitor the loom rotation angle until that angle matches angle $\theta$, at which point the decision changes to "YES" and the sequence progresses. The other subsequent upwards-directed "NO" arrows have similar meanings for the subsequent loom rotation values as shown in FIG. 3.

When the weft $Y_2$ is to be next inserted, the central processing unit CPU reads out selectively from the memory $C_2$ the on/off timing $[\alpha_i-\Delta, \beta_{2i}-\Delta]$ for the solenoid valves $V_{2+i}$ to command the turn-on of the solenoid valves $V_{2+i}$ at the loom rotation angles $(\alpha_i-\Delta)$ while commanding the turn-off of the solenoid valves $V_{2+i}$ at the loom rotation angles $(\beta_{2i}-\Delta)$, respectively. In this way, the weft inserting auxiliary nozzles connected groupwise to the valves $V_{2+i}$ eject the air jets within the range of loom rotation angles from $\alpha_i$ to $\beta_{2i}$, as the result of which the weft $Y_2$ is forced to run in such a manner as indicated by a curve $D_2$ in FIG. 2B.

Through the weft insertion control according to which the jet timing $[\alpha_i, \beta_{1i}]$ is set for the weft $Y_1$ to be inserted with the jet timing $[\alpha_i, \beta_{2i}]$ being set to the weft $Y_2$ to be inserted, the wefts $Y_1$ and $Y_2$ are inserted in a relaying manner in optimal jet timing. In other words, the weft $Y_1$ of a small count which is intrinsically of a high running speed is prevented from running at an abnormally high speed while the weft $Y_2$ of a large count which is intrinsically low in running speed is protected against flying at an abnormally low speed. Thus, weft breakage due to the running of the thin weft $Y_1$ at an excessively high speed as well as insertion failure of a thick weft $Y_2$ due to the running thereof at an excessively low speed can be positively prevented, while the amount of air consumption can be reduced. By virtue of the selective jet ejection timing control described above, a satisfactory weft insertion can be achieved without the need for additionally providing a pressurized air supply tank for the weft inserting auxiliary nozzle groups 3 to 10 as well as additional piping therefor, whereby the problems of increase in installation space and cost can be avoided.

The present invention is not to be limited to the embodiment described above, but may be modified or varied without departing from the spirit and scope of the invention and equivalents thereto. For example, although it has been described that the memories $C_1$ and $C_2$ are provided separately, it is obvious that they may be implemented in a single memory. Further, it goes without saying that the timing at which the solenoid valves $V_{2+i}$ are turned on may be changed in conformance with the types of wefts. Further, the invention can be equally applied to a jet loom in which the pressurized air supply tank for the weft inserting auxiliary nozzle group 10 is provided separately from that for the other auxiliary nozzle groups 3 to 9, wherein the ejection pressure of the weft inserting auxiliary nozzle group 10 is increased as compared with that of the other auxiliary nozzle groups 3 to 9.

As will now be appreciated from the foregoing description, according to the teaching of the present invention that the jet timing of the weft inserting auxiliary nozzles is selectively changed in conformance with the types of wefts to be inserted, the ejection or jet timing can be optimally set for the types of wefts to allow satisfactory weft insertion to be achieved without the need for expanding the pressurized fluid supply system.

I claim:

1. In a multi-color jet loom of the type having a rotating crankshaft, wherein one of a plurality of weft inserting main nozzles is selected in accordance with a weft color selection pattern, and a weft is jetted from said selected weft inserting main nozzle to be inserted through relaying jets produced sequentially by a plurality of weft inserting auxiliary nozzles, a method of controlling weft insertion comprising the steps of:

providing a plurality of solenoid valves for controlling supply of a pressurized fluid to said weft inserting auxiliary nozzles;

providing on/off control means for controlling said solenoid valves independent of one another;

storing the weft color selection pattern in a memory means;

storing on/off timings of said individual solenoid valves preset on a weft basis;

reading said stored weft color selection pattern for every crankshaft rotation by said on/off control means to determine the type of weft to be inserted; and validating selectively said preset on/off timing on the basis of the result of said reading step to thereby control said solenoid valves by said on/off control means so that each solenoid valve can supply a pressurized fluid in accordance with the determined type of weft to be inserted for increasing the time a valve is on when the weft has an inherently low running speed and decreasing the time a valve is on when the weft has an inherently high running speed.

2. A weft insertion control apparatus in a multi-color jet loom of the type having a rotating crankshaft, wherein one of a plurality of weft inserting main nozzles is selected in accordance with a weft color selection pattern, and a weft is jetted from said selected weft inserting main nozzle to be inserted through relaying jets produced sequentially by a plurality of weft inserting auxiliary nozzles, said control apparatus comprising:

a plurality of solenoid valves for controlling supply of a pressurized fluid to said weft inserting auxiliary nozzles;

on/off control means for controlling said solenoid valves independent of one another;

first memory means for storing the weft color selection pattern;

second memory means for storing on/off timing of said individual solenoid valves preset on a weft basis;

wherein said on/off control means reads out said stored weft color selection pattern for every crankshaft rotation, and selects said preset on/off timing on the basis of the result of said reading to thereby control said solenoid valves so that each solenoid valve can supply a pressurized fluid in accordance with the determined type of weft to be inserted for increasing the time a valve is on when the weft has an inherently low running speed and decreasing the time a valve is on when the weft has an inherently high running speed; and wherein said on/off control means comprises a central processing unit of a control computer, and first and second storing means are constituted by said first and second memory means which are incorporated in said control computer.

3. A weft insertion control apparatus according to claim 2, further including an encoder for detecting a rotation angle of said loom, a weft color selection pattern input unit for inputting the weft color selection pattern to be set in said first memory means through said central processing unit, and an on/off timing setting unit for setting said solenoid valve on/off timing in said second memory means through said central processing unit, each of which are connected to said control computer.

4. A weft insertion control apparatus according to claim 2, wherein said weft inserting auxiliary nozzles are grouped into a plurality of sets which are associated with said plurality of solenoid valves, respectively.

5. A weft insertion control apparatus according to claim 2, wherein said control computer is a loom control computer.

* * * * *